US010243279B2

(12) United States Patent
Liu

(10) Patent No.: US 10,243,279 B2
(45) Date of Patent: Mar. 26, 2019

(54) SLOT ANTENNA WITH RADIATOR ELEMENT

(71) Applicant: Microsoft Technology Licensing, LLC, Redmond, WA (US)

(72) Inventor: Luyi Liu, Sammamish, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 133 days.

(21) Appl. No.: 15/056,814

(22) Filed: Feb. 29, 2016

(65) Prior Publication Data

US 2017/0250475 A1 Aug. 31, 2017

(51) Int. Cl.

| | |
|---|---|
| ***H01Q 1/24*** | (2006.01) |
| ***H01Q 21/30*** | (2006.01) |
| ***H01Q 13/10*** | (2006.01) |
| ***H01Q 1/22*** | (2006.01) |
| ***H01Q 5/371*** | (2015.01) |

(52) U.S. Cl.

CPC ..... *H01Q 21/30* (2013.01); *H01Q 1/2266* (2013.01); *H01Q 1/24* (2013.01); *H01Q 1/243* (2013.01); *H01Q 5/371* (2015.01); *H01Q 13/10* (2013.01); *H01Q 13/106* (2013.01)

(58) Field of Classification Search

None

See application file for complete search history.

(56) References Cited

U.S. PATENT DOCUMENTS

| | | | | |
|---|---|---|---|---|
| 6,140,967 | A * | 10/2000 | Kolsrud | H01Q 1/38 343/700 MS |
| 8,207,897 | B2 | 6/2012 | Alvey et al. | |
| 8,390,523 | B2 | 3/2013 | Wang et al. | |
| 8,648,752 | B2 | 2/2014 | Ramachandran et al. | |
| 8,872,708 | B2 | 10/2014 | Hill et al. | |

(Continued)

FOREIGN PATENT DOCUMENTS

| | | | |
|---|---|---|---|
| EP | 1063721 | A1 | 12/2000 |
| WO | 2013107921 | A1 | 7/2013 |

(Continued)

OTHER PUBLICATIONS

"International Search Report and Written Opinion Issued in PCT Application No. PCT/US2017/019224", dated Jun. 8, 2017, 13 Pages.

(Continued)

*Primary Examiner* — Trinh V Dinh

(74) *Attorney, Agent, or Firm* — Holzer Patel Drennan

(57) ABSTRACT

An antenna assembly includes a conductive plate having a slot formed within the conductive plate. A conductive coupling element is positioned within the slot of the conductive plate to form a slot antenna structure with the conductive plate. At least one conductive radiator element is positioned outside of the slot. An antenna feed structure is electrically coupled to the conductive coupling element and the at least one conductive radiator element. The antenna feed structure is configured to simultaneously resonate the slot antenna structure and the at least one conductive radiator element. The slot antenna structure and the conductive radiator element work in combination to resonate at substantially similar (e.g., overlapping) RF communication bands or at different RF communication bands.

19 Claims, 5 Drawing Sheets

(56) References Cited

U.S. PATENT DOCUMENTS

| | | | | |
|---|---|---|---|---|
| 8,896,487 | B2 | 11/2014 | Chiang et al. | |
| 8,963,783 | B2 | 2/2015 | Vin et al. | |
| 9,543,639 | B2 * | 1/2017 | Iellici | H01Q 1/243 |
| 2008/0067715 | A1 | 3/2008 | Sung | |
| 2009/0140927 | A1 * | 6/2009 | Maeda | H01Q 9/0407 343/700 MS |
| 2009/0153407 | A1 | 6/2009 | Zhang et al. | |
| 2012/0154223 | A1 | 6/2012 | Oh et al. | |
| 2013/0082884 | A1 | 4/2013 | Gummalla | |
| 2013/0106665 | A1 | 5/2013 | Hill et al. | |
| 2013/0127674 | A1 | 5/2013 | Korva | |
| 2013/0147669 | A1 | 6/2013 | Mao | |
| 2014/0313098 | A1 | 10/2014 | Lin | |
| 2014/0333504 | A1 | 11/2014 | Basirat | |
| 2014/0347225 | A1 | 11/2014 | Harper | |
| 2014/0347226 | A1 * | 11/2014 | Iellici | H01Q 1/243 343/702 |
| 2015/0280323 | A1 * | 10/2015 | Liu | H01Q 1/243 343/745 |
| 2015/0340757 | A1 * | 11/2015 | Rho | H01Q 1/46 343/702 |

FOREIGN PATENT DOCUMENTS

| | | | |
|---|---|---|---|
| WO | 2014190301 | A1 | 11/2014 |
| WO | 2014190306 | A1 | 11/2014 |

OTHER PUBLICATIONS

Anguera, et al., "Advances in Antenna Technology for Wireless Handheld Devices", In International Journal of Antennas and Propagation, vol. 2013, Sep. 8, 2013, pp. 1-25.

Caporal Del Barrio et al., "Coupling Element Antenna with Slot Tuning for Handheld Devices at LTE Frequencies", In Conference Paper, Mar. 2012, 5 pages.

* cited by examiner

SLOT ANTENNA WITH RADIATOR ELEMENT

BRIEF DESCRIPTIONS OF THE DRAWINGS

DETAILED DESCRIPTIONS

Many computing devices include one or more antennas to receive and transmit radio waves within one or more select radiofrequency (RF) communication frequency bands. Antenna design is affected by, among other things, target transmitting and receiving RF communication frequencies and industrial design incentives. Industrial design incentives may include, for example, the size and shape of the device, the location of an antenna on the device, and the material of the device case.

Implementations described and claimed herein provide an antenna assembly including a conductive plate having a slot formed within the conductive plate. A conductive coupling element is positioned within the slot of the conductive plate to form a slot antenna structure with the conductive plate. At least one conductive radiator element is positioned outside of the slot. An antenna feed structure is electrically coupled to the conductive coupling element and the at least one conductive radiator element. The antenna feed structure is configured to simultaneously resonate the slot antenna structure and the at least one conductive radiator element. The slot antenna structure and the conductive radiator element may work in combination to resonate at substantially similar (e.g., overlapping) RF communication bands or at different RF communication bands.

Figure 1:
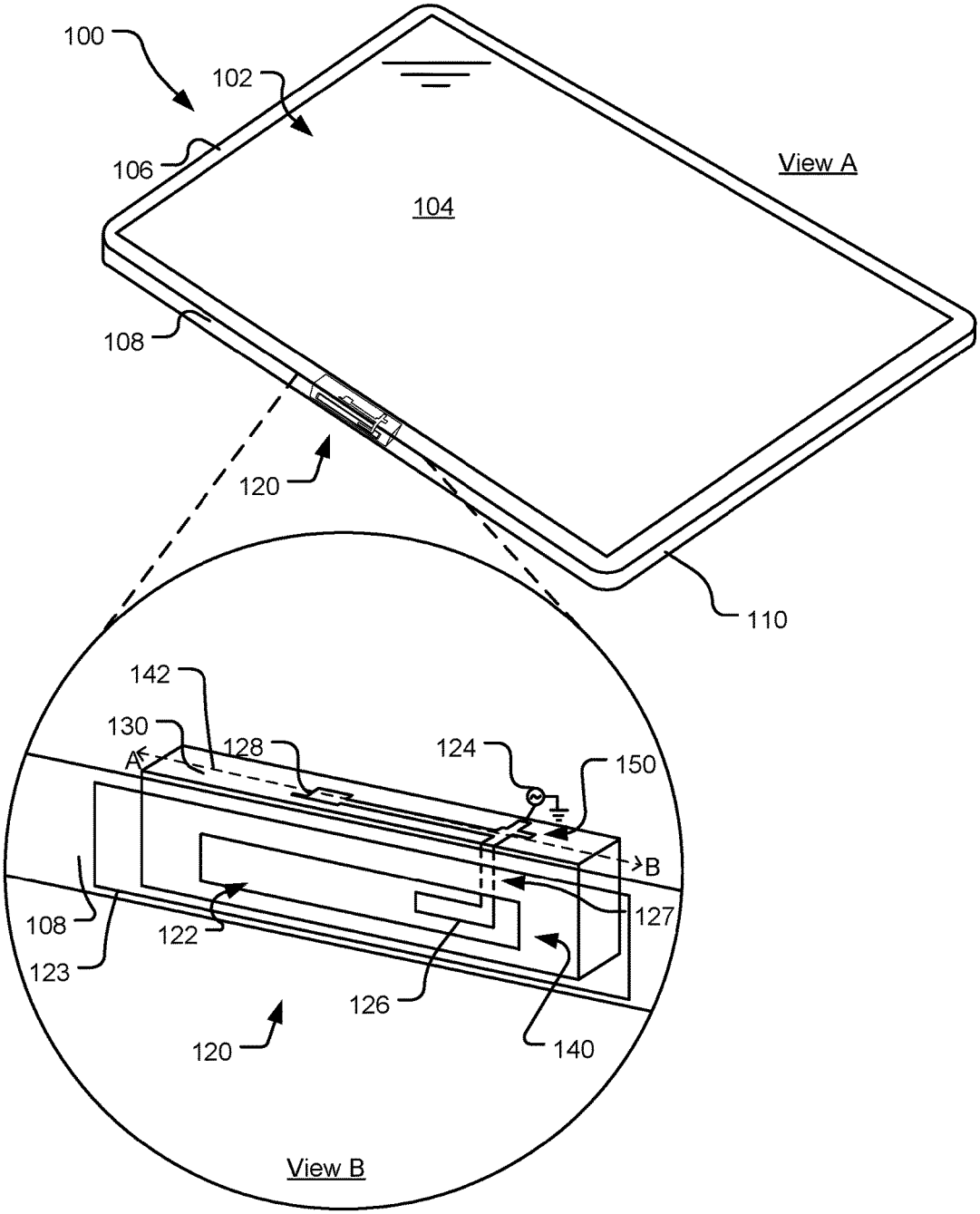
FIG. 1 illustrates an example computing device including an example antenna assembly.

FIG. 1 illustrates an example computing device 100 including an example antenna assembly 120. Referring to View A, the computing device 100 may be, without limitation, a tablet computer, laptop, mobile phone, personal data assistant, cell phone, smart phone, Blu-Ray player, gaming system or any other device including wireless communications circuitry for transmission of a radiofrequency (RF) carrier wave. In this example implementation, the computing device 100 includes computing device case having a front face 102 that includes a display surface 104, although non-display surfaces may be employed in the front face 102. The display surface 104 is surrounded by a bezel 106. A back face of the computing device case is also not shown. In some implementations, the display surface 104 extends across the entire front face 102. The computing device case further includes side faces 108 and 110 as well as other similar side faces (not shown). The front face 102, the bezel 106, the side faces (including side faces 108 and 110), and the back face may be formed, at least in part, from a conductive material, such as metal. Further, each of the front face 102, the bezel 106. the side faces, and the back face may form a conductive plate, individually or in combination. Other materials used in the computing device case may include plastics, glass, and various RF signal transparent materials.

View B shows an expanded view of the antenna assembly 120 of the computing device 100. The antenna assembly 120 includes a slot antenna structure 140 having a slot 122 formed as a closed aperture in a conductive (e.g., metal) plate 123 and a conductive coupling element 126 positioned in the side face 108 of the computing device case. In one implementation, the slot antenna structure 140 is substantially coplanar with or parallel to the side face 108. The conductive coupling element 126 is insulated from the metal plate 123 (e.g., to avoid conductive contact between the metal plate 123 and the conductive coupling element 126). For example, a portion 127 of the conductive coupling element 126 that extends behind the metal plate 123 is insulated from the metal plate 123. The conductive coupling element 126 may be positioned within the slot 122 such that the conductive coupling element 126 is coplanar with the metal plate 123 (e.g., in a same plane with the edges of the slot 122 of the metal plate 123). Alternatively, the conductive coupling element 126 may be positioned within the slot 122 such that the conductive coupling element 126 may be offset from the metal plate 123 but still within the two dimensional bounds of the slot 122. The conductive coupling element is positioned to capacitively couple with the slot 122 such that when driven with an RF signal, the conductive coupling element 126 induces a current at the edges of the slot 122, and the slot 122 radiates electromagnetic waves.

A conductive radiating element 128 provides another component of the antenna assembly 120. The conductive radiating element 128 is shown as a planar radiating element positioned on the front face 102 of the computing device case, substantially coplanar with or parallel to the front face 102. The antenna assembly 120 also includes an antenna feed structure 124 (including a grounded RF signal source) to which the conductive coupling element 126 of the slot antenna structure 140 and the conductive radiating element 128 are electrically connected at a common feed junction 150 for transmission and reception of RF signals. (It should be understood that separate, non-common junctions may connect the conductive coupling element 126 and the conducting radiating element 128 to the antenna feed structure 124. The slot antenna structure 140 and the conductive radiating element 128 are supported on an antenna carrier 130.

The antenna feed structure 124 may be electrically connected to a printed circuit board assembly (PCBA) (not shown) of the computing device 100 that may include components such as a transceiver, switch banks, filters, impedance matching components, an RF signal source, etc. Although a variety of connection components may be suitable for implementing the antenna feed structure 124, the antenna feed structure 124 may include or be connected to, without limitation, a directly soldered connection, a continuous feed, a metal spring contact, a coaxial cable, etc.

In the example implementation shown in View B of FIG. 1, the side face 108 of the computing device 100 includes the slot 122. The slot 122 may be cut or formed in the conductive plate, which may be coplanar with, integral with, or parallel to the side face 108 and forms a portion of the antenna assembly 120. It should be understood that the computing device 100 may include one or more antenna assemblies (e.g., the antenna assembly 120) positioned on the different faces (e.g., the front face 102, the side faces 108 and 110, the bezel 106, or a back face (not shown). In FIG. 1, the slot 122 is shown as a substantially rectangular aperture, although other configurations are contemplated.

The shape and size of the slot 122, as well as the frequency of the driving RF signal, determine the radiation distribution pattern.

The front face 102, the side faces 108, and 110, and the back face (not shown) may make up a metal computing device case. In other implementations, fewer than four sides may partially bound the back face. In addition, the back face and the side faces 108 and 110 may be joined at an abrupt corner, at a curved corner (e.g., a continuous arc between the back face and the side face), or in various continuous intersecting surface combinations. Furthermore, the side faces need not be perpendicular to the back face (e.g., a side face may be positioned at an obtuse or acute angle with the back face). In one implementation, the back face and one or more side faces (e.g., the side faces 108 and 110) are integrated into a single piece construction, although other assembled configurations are also contemplated.

The conductive coupling element 126 and the conductive radiator element 128 share the common feed junction 150, which is electrically coupled to the antenna feed structure 124. The conductive coupling element 126 and the conductive radiator element 128 may assume a variety of shapes and sizes, and may be constructed from a variety of suitable metallic materials including, for example, one or more flexible printed circuits (FPC), materials formed by laser direct structuring (LDS) material, or other manufactured metals. The conductive coupling element 126 and the conductive radiator element 128 may be constructed from the same materials and may form a continuous conductive structure. Alternatively, the conductive coupling element 126 and the conductive radiator element 128 may be separate structures but connected to a common antenna feed structure (e.g., the antenna feed structure 124). Both the conductive coupling element 128 and the conductive radiator element radiate an oscillating radiofrequency signal. The conductive coupling element's 128 oscillating RF signal induces the current around the slot 122. Furthermore, the conductive coupling element 126 and the conductive radiator element 128 may be configured to resonate at target RF communication bands. For example, the conductive radiator element 128 may be sized and shaped to resonate at a first target RF communication band in a first implementation. In a second implementation, the conductive radiator element 128 may be sized and shaped differently to resonate at a second target RF communication band. The conductive coupling element 126 and the conductive radiator element 128 can be excited directly (e.g., glavanically), capacitively, or via some other excitation method. In some implementations, the conductive coupling element 126 and/or the conductive radiator element are three dimensional structures. In alternative implementations, the conductive coupling element 126 and/or the conductive radiator element 128 are planar structures.

The conductive coupling element 126 is positioned within the slot 122 of the computing device 100 forming a slot antenna structure 140. When the antenna feed structure 124 provides a signal of one or more select RF communication frequencies, the conductive coupling element 126 resonates (e.g., transmits or receives a carrier wave) in a near field of a resonate frequency, which in turn is reflected in changes in the edge current of the slot 122 of the computing device 100 (e.g., the conductive coupling element 126 and the slot 122 are capacitively coupled). The select RF communication frequencies and pattern depend on, in part, the size and shape of the slot 122. The conductive radiator element 128 may be configured to resonate in a same or substantially similar (e.g., overlapping) RF communication band as the edge current of the slot 122. Overlapping bands may be defined by the frequencies between a band pass cutoff condition in a reflection coefficient response graph (see FIG. 3 and its detailed description). In effect, the conductive radiator element 128 and the slot antenna structure 140 form cooperative resonating components, each component providing a contribution to the strength of the RF signal radiating at the select RF communication band. When the conductive radiator element 128 is used in combination with the slot antenna structure 140, an improvement in resonance strength and/or bandwidth may be realized, when compared to implementations using the slot antenna structure 140 or conductive radiator element 128 in isolation.

The antenna assembly 120 including the slot 122, the antenna feed structure 124, the conductive coupling element 126, the conductive radiator element 128, and the antenna carrier 130 may be arranged and positioned according to particular industrial design requirements of a computing device (e.g., the computing device 100). Furthermore, a select frequency band may require a slot length that may impinge upon particular industrial design requirements. The antenna assemblies (e.g., antenna assembly 120) described herein may provide a shorter or longer slot while increasing or maintaining antenna resonance strength and/or bandwidth at the select RF communication band.

The antenna carrier 130 is a constructed from a RF transparent material such as plastic, ceramic, other dielectric or insulating material or other materials. The conductive coupling element 126 and the conductive radiator element 128 may be printed on the antenna carrier 130, or the antenna carrier 130 may be filled/formed around the conductive coupling element 126 and the conductive radiator element 128. As such, the conductive coupling element 126 may be positioned offset from a surface of the antenna carrier 130 or may be positioned coplanar with the surface of the antenna carrier 130. The conductive radiator element may be similarly positioned (e.g., offset from a surface of the antenna carrier or coplanar with a surface of the antenna carrier 130). In FIG. 1, the conductive coupling element 126 and the conductive radiator element 128 are illustrated as being positioned on perpendicular planes on the antenna carrier 130, although other configurations are contemplated (e.g., on the same surface or plane, on substantially parallel opposing planes). Furthermore, the conductive radiator element 128 is extending from the common feed junction 150 in an A direction (e.g., the A direction on line 142). However, it should be understood that the conductive radiator element 128 may extend in a B direction (e.g., the B direction on line 142) or in another direction (e.g., a direction perpendicular to the line 142). It should be understood that other configurations are contemplated, and the position of the conductive radiator element 128 may depend on particular design requirements of the computing device 100.

In some implementations, the antenna assembly may allow for communication in more than one RF communication band. For example, the slot antenna structure 140 may have a high mode of resonance in addition to the regular mode of resonance, which may allow for communication using both the high mode of resonance and the regular mode of resonance. In the same or different implementations, the conductive radiator element 128 may be configured to resonate in a different RF communication band than the slot antenna structure 140, allowing for two select RF communication bands for RF communication. In the same or different implementations, the conductive radiator element 128 may be tunable to operate in two or more select RF communication bands. For example, the radiator may be electrically coupled to a tunable circuit with an inductor-capacitor (LC) tank and a series resonator configured to generate more than one resonance frequency.

In some implementations, the antenna assembly 120 may include more than one conductive radiator element (e.g., the conductive radiator element 128), such that the more than one conductive radiator elements radiate together in a target RF communication band. In another implementation, each conductive radiator element of the more than one conductive radiator element may resonate at different RF communication bands such that the antenna assembly (e.g., the antenna assembly 120) may provide multi-band transmission.

In the same or alternative implementations, the conductive metal plate 123 may include more than one slot (e.g., the slot 122). In this implementation, the antenna assembly 120 may include more than one conductive coupling element (e.g., conductive coupling element 126) such that each conductive coupling element is positioned within a slot of the metal plate. Each conductive coupling element, slot, and one or more conductive radiator elements may provide enhanced signal strength at a select RF communication band. In another implementation, each conductive coupling element and slot may be configured to operate at different RF communication bands.

The above-described antenna assembly configurations can be used to communicate in select RF communication bands. A number of antenna assemblies can be used in combination for transmission in a number of desired RF communication bands. These configurations are described further with respect to the following figures.

Figure 2:
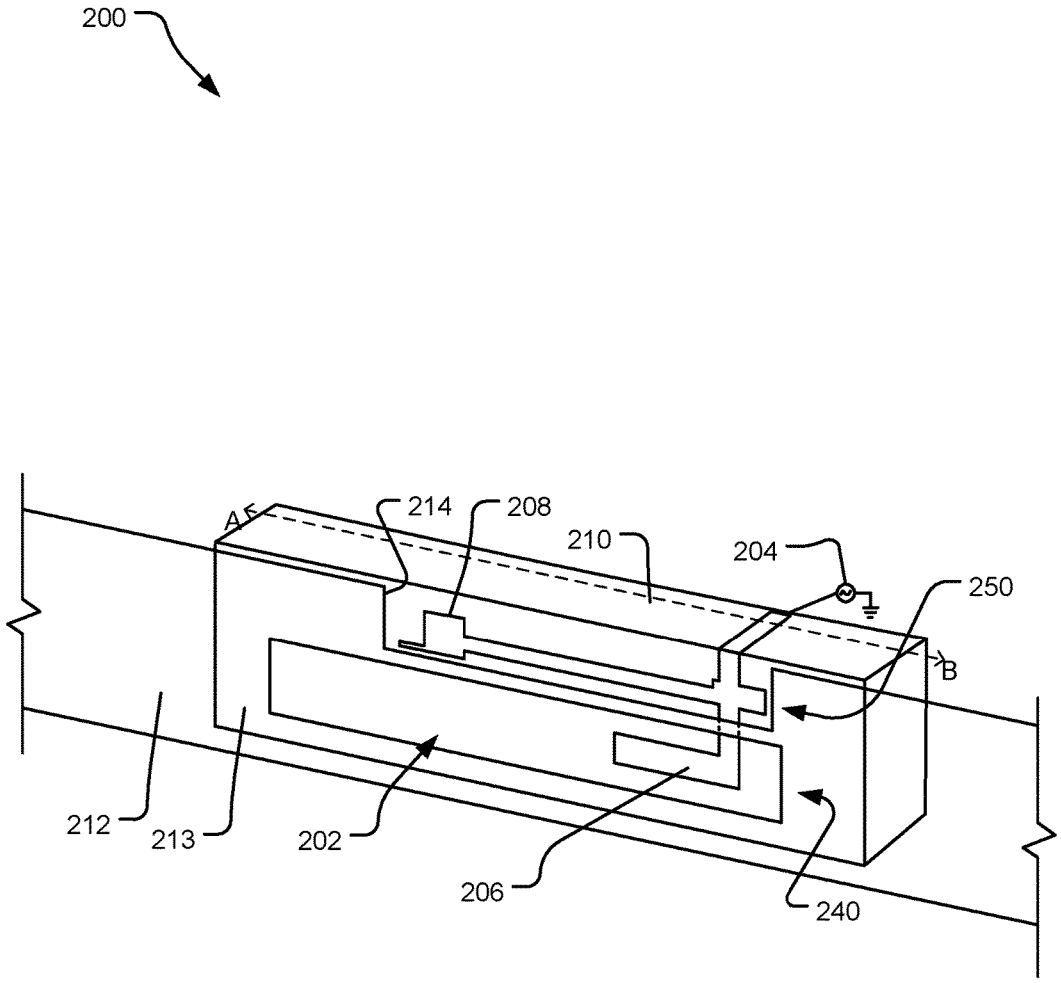
FIG. 2 illustrates another example antenna assembly of an example computing device.

FIG. 2 illustrates another example antenna assembly 200 of an example computing device. The antenna assembly 200 includes a slot antenna structure 240 having a slot 202 formed as a closed aperture in a conductive (e.g., metal) plate 213 and a conductive coupling element 206 positioned in a side face 212 of a computing device case of the computing device. In one implementation, the slot antenna structure 240 is substantially coplanar with or parallel to the side face 212. The conductive coupling element 206 is insulated from the metal plate 213 (e.g., to avoid conductive contact between the metal plate 213 and the conductive coupling element 206). The conductive coupling element 206 extends into the slot 202. When driven with an RF signal, the conductive coupling element 206 induces a current at the edges of the slot 202, and the slot 202 radiates electromagnetic waves.

A conductive radiating element 208 provides another component of the antenna assembly 200. The conductive radiating element 208 is shown as a planar radiating element positioned on the side face 212 of the computing device case, substantially coplanar with or parallel to the side face 212. The antenna assembly 200 also includes an antenna feed structure 204 (including a grounded RF signal source) to which the conductive coupling element 206 of the slot antenna structure 240 and the conductive radiating element 208 are electrically connected at a common feed junction 250 for transmission and reception of RF signals. (It should be understood that separate, non-common junctions may connect the conductive coupling element 206 and the conducting radiating element 208 to the antenna feed structure 204. The slot antenna structure 240 and the conductive radiating element 208 are supported on an antenna carrier 130, wherein the conductive radiating element 208 is positioned in an area of the antenna carrier 210 that is not shielded by a conductive surface. Accordingly, in FIG. 2, the conductive radiating element 208 is positioned within a cut-out 214 of the metal plate 213 to prevent shielding of the conductive radiating element 208.

The antenna feed structure 204 may be electrically connected to a printed circuit board assembly (PCBA) (not shown) of the computing device that may include components such as a transceiver, switch banks, filters, impedance matching components, an RF signal source, etc. Although a variety of connection components may be suitable for implementing the antenna feed structure 204, the antenna feed structure 204 may include or be connected to, without limitation, a directly soldered connection, a continuous feed, a metal spring contact, a coaxial cable, etc.

The slot 202 may be cut or formed in a side face 212 of a computing device (not shown). It should be understood that the computing device may include one or more slots (e.g., the slot 202) and antenna assemblies (e.g., the antenna assembly 200) positioned on different faces. Furthermore, the side face 212 of the computing device may be formed or made from a conductive material such as metal, and as such may form a conductive plate so that the slot 202 may resonate as hereinafter described.

The antenna feed structure 204 may be electrically connected to a printed circuit board assembly (PCBA) (not shown) of the computing device. Although a variety of components may be suitable for implementing the antenna feed structure 204, the antenna feed structure 204 is in different implementations, a directly soldered connection, a continuous feed, a metal spring contact, a coaxial cable, etc. The antenna feed structure 204 may be electrically grounded.

The conductive coupling element 206 and the conductive radiator element 208 share a common feed junction 250, which is electrically coupled to the antenna feed structure 204. The conductive coupling element 206 and the conductive radiator element 208 may assume a variety of shapes and sizes, and may be constructed from a variety of suitable metallic materials including, for example, one or more flexible printed circuits (FPC), materials formed by laser direct structuring (LDS) material, or other manufactured metals. The conductive coupling element 206 and the conductive radiator element 208 may be constructed from the same materials and may form a continuous conductive structure. Alternatively, the conductive coupling element 206 and the conductive radiator element 208 may be separate structures but connected to a common antenna feed structure (e.g., the antenna feed structure 204). Furthermore, the conductive coupling element 206 and the conductive radiator element 208 may be configured to resonate at a target RF communication band. For example, the conductive radiator element 208 may be sized and shaped so as to resonate at a first target RF communication band in a first implementation. In a second implementation, the conductive radiator element 208 may be sized and shaped differently so as to resonate at a second target RF communication band. The conductive coupling element 206 and the conductive radiator element 208 may be planar or three dimensional structures.

The conductive coupling element 206 is positioned within the slot 202 of the computing device forming a slot antenna structure 240. When the antenna feed structure 204 provides a signal of one or more select RF communication frequencies, the conductive coupling element 206 resonates (e.g., transmits a carrier wave) in a near field of a resonate frequency, which in turn excites an edge current of the slot 202 of the computing device. The slot antenna structure 240 is configured to provide a resonance at a target RF communication band. The target RF communication frequency depends on, in part, the size and shape of the slot 202. The conductive radiator element 208 may be configured to resonate in a same or substantially similar (e.g., overlapping) RF communication bands as the slot antenna structure 240. Overlapping RF communication bands may be defined by the frequencies between a band pass cutoff condition in a reflection coefficient graph (see FIG. 3 and its detailed description). In effect, the conductive radiator element 208 and the slot antenna structure 240 form cooperative resonating components, each component providing a contribution to the resonance strength at the select RF communication band. As a result, the conductive radiator element 208 may be used in combination with the conductive coupling element 206 and slot 202 (e.g., the slot antenna structure 240) to communicate at a target RF communication band. When the conductive radiator element 208 is used in combination with the slot antenna structure 240, an improvement in resonance strength and/or bandwidth may be realized, when compared to implementations using a slot or conductive radiator element in isolation.

The antenna carrier 210 is constructed from a RF transparent material such as plastic, ceramic, or other dielectric or insulating material. The conductive coupling element 206 and the conductive radiator element 208 may be printed or otherwise attached to the antenna carrier 210. In some aspects, the RF transparent material may be formed/molded around the conductive coupling element 206 and the conductive radiator element 208. In this illustrated example implementation, the conductive coupling element 206 and the conductive radiator element 208 are positioned coplanar with the surface of the antenna carrier 210; however, it should be understood that the conductive coupling element 206 and the conductive radiator element 208 may be positioned offset from the surface of the antenna carrier 210. Because a conductive material shields operation of conductive radiator element 208, the metal plate 213 at the side face 212 includes the cut-out 214 wherein the conductive radiator element 208 is positioned. Furthermore, the conductive radiator element 208 may be positioned on a bezel of a computing device, under a display surface of a computing device or elsewhere on a computing device.

Figure 3:
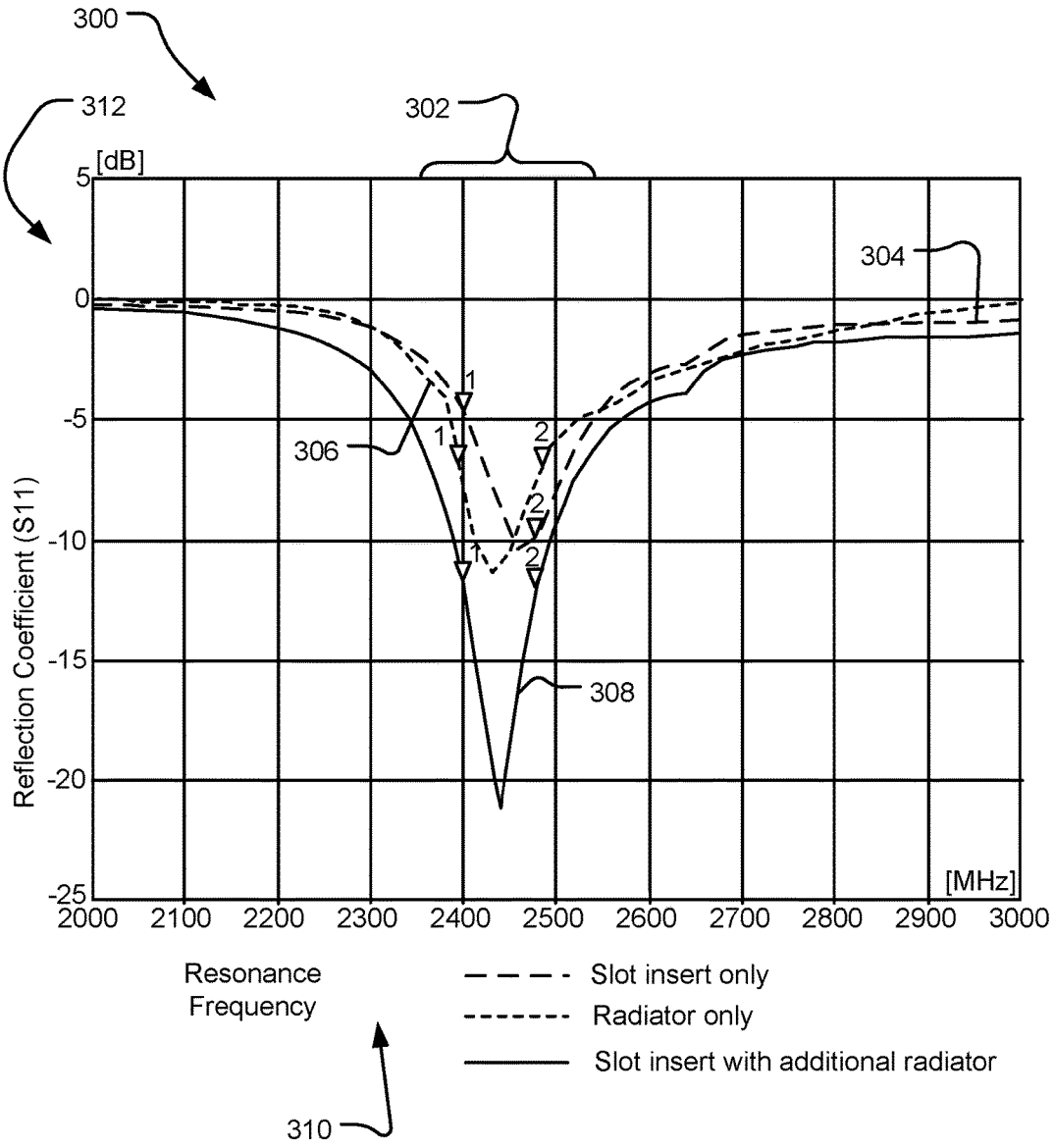
FIG. 3 illustrates a graph showing resonant statistic plots for three example antennas of an example antenna assembly.

FIG. 3 illustrates a graph 300 showing resonant statistic plots for three antenna assemblies. The horizontal axis 310 represents the resonance frequency of the antenna assemblies in GHz. The vertical axis 312 represents the reflection coefficient (s11) of the antenna (e.g., the amount of power the antenna accepts) in dB. A low reflection coefficient represents a strong performance of the antenna. The graph 300 indicates a target resonance 302 centered between 2400 MHz and 2500 MHz. A first plot 304 shows the operating range of an antenna assembly having only a slot structure (e.g., a coupling element and a slot of a metal plate). A second plot 306 shows the operating range of an antenna assembly having only a conductive radiator element. A third plot 308 shows the operating range of an antenna assembly having a slot structure and a conductive radiator element (as illustrated and described above with respect to FIG. 1 and FIG. 2). As can be seen, the antenna assemblies of the first plot 304 and the second plot 306 are configured to resonate at overlapping RF communication bands. Overlapping RF communication bands may be defined by a band pass cutoff condition. A band pass cutoff condition may be, without limitation, the frequency responses between −3 dB, −6 dB, −10 dB, etc. In other words, the overlapping bands are defined by a band pass cutoff condition, wherein the band pass cutoff condition is where the s11 is below −3 db, −6 db, or −10 db. Other band pass cutoff conditions are contemplated. The third plot 308 indicates the result of the combined antenna assemblies (e.g., the antenna assembly having the slot antenna structure and the additional conductive radiator element). The overlapping RF communication bands of the two combined antenna assemblies compound to provide stronger performance (e.g., less reflection coefficient) compared to antenna assemblies having only one of the elements. Furthermore, the third plot 308 indicates that the antenna assembly having a slot structure and a conductive radiator element provides a wide bandwidth compared to the first plot 304 and the second plot 306. As a result, an antenna assembly having a slot structure and an additional conductive radiator may be used to provide an increase in resonance strength and/or bandwidth at a select RF communication band.

It should be understood that the antenna assemblies described and illustrate herein are exemplary of a wide array of implementations utilizing the disclosed technology. Other slots, conductive coupling elements, radiating elements, and feed structure configurations can result in different antenna resonance bands that may correspond with RF communication frequencies used in any radio standard or protocol including without limitation UMTS, GSM LTE, 4G, 3G, Wi-Fi, WiMAX, Bluetooth, Miracast, and other standards that may be developed in the future.

Figure 4:
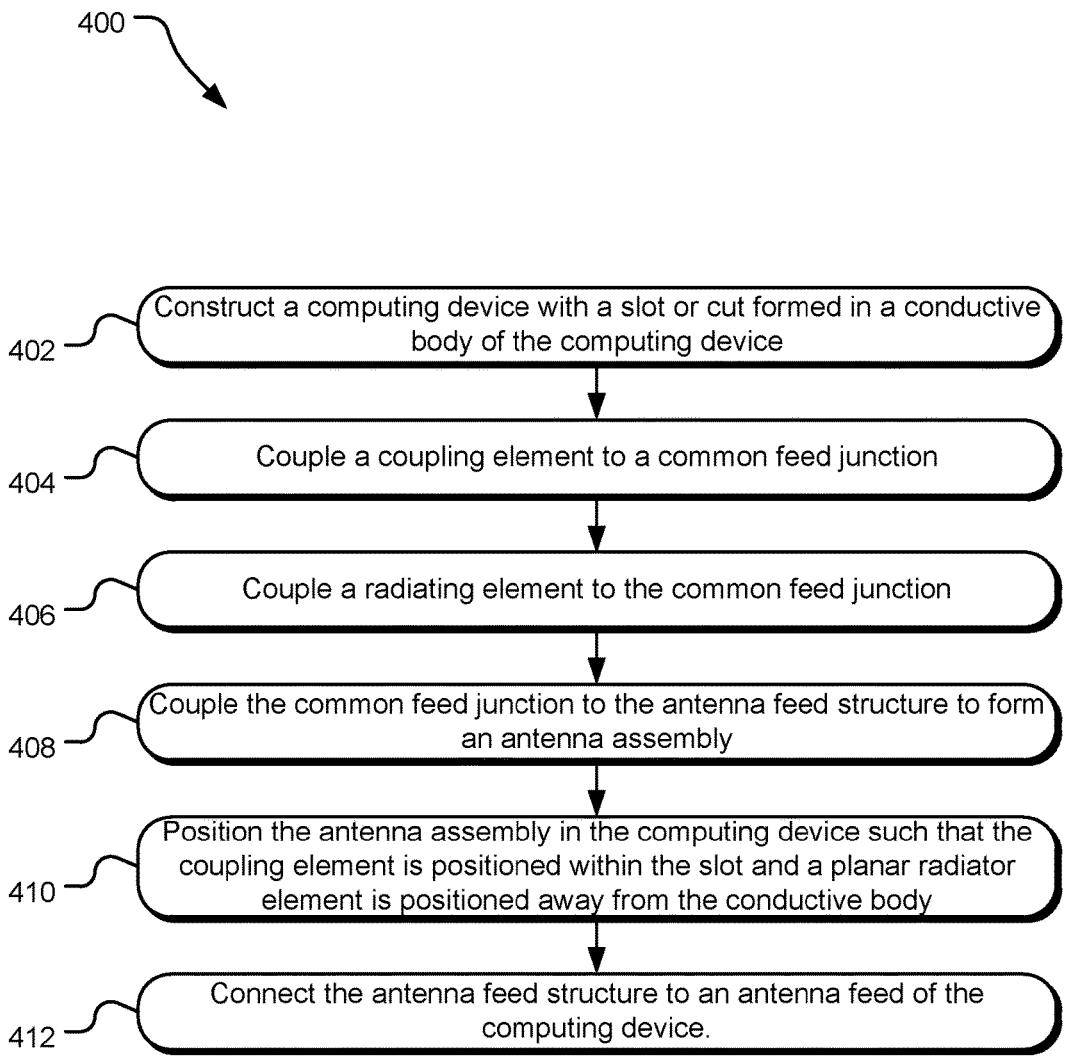
FIG. 4 illustrates example operations for manufacturing a slot antenna with a conductive radiator element.

FIG. 4 illustrates example operations for manufacturing a slot antenna with a conductive radiator element. A constructing operation 402 constructs a computing device with a slot cut or formed in a conductive plate of the computing device. The computing device may be, without limitation, a tablet computer, laptop, mobile phone, personal data assistant, cell phone, smart phone, Blu-Ray player, gaming system or any other device including wireless communications circuitry for transmission of a radiofrequency (RF) carrier wave. The slot may be formed in a front face, side face, back face, or any other face of the computing device. The slot is formed or cut in a conductive plate, such as a plate made of metal, which may comprise a portion of the computing device case. The size, shape and location of the slot may depend on a target RF communication band and/or industrial design requirements of the computing device.

A first coupling operation 404 couples a conductive coupling element to a common feed junction. A second coupling operation 406 couples a radiating element to the common feed junction. The conductive coupling element and the radiating element may be sized and shaped to resonate in one or more select RF communication bands. The conductive coupling element and radiating element may be constructed from a variety of suitable metallic materials including, for example, one or more flexible printed circuits (FPC), materials formed by laser direct structuring (LDS) material, or other manufactured metals. The conductive coupling element and the radiating element may be positioned on the same surfaces or different surfaces of an RF carrier. The RF carrier may be formed of an RF transparent material such as plastic, ceramic, or other dielectric or insulating material. A third coupling operation 408 couples the common feed junction to the antenna feed structure to form an antenna assembly. The coupling operations 402, 404, 406 may be achieved in one or more steps by printing the structures (e.g., the conductive coupling element, conductive radiator element, and common feed junction) on the antenna carrier. In alternative, implementations, the conductive radiator element, conductive coupling element, and common feed junction may be constructed, and then the antenna carrier may be formed or molded around the structures. Furthermore, the antenna feed structure may be formed on the antenna assembly or may be a part of the computing device.

Figure 5:
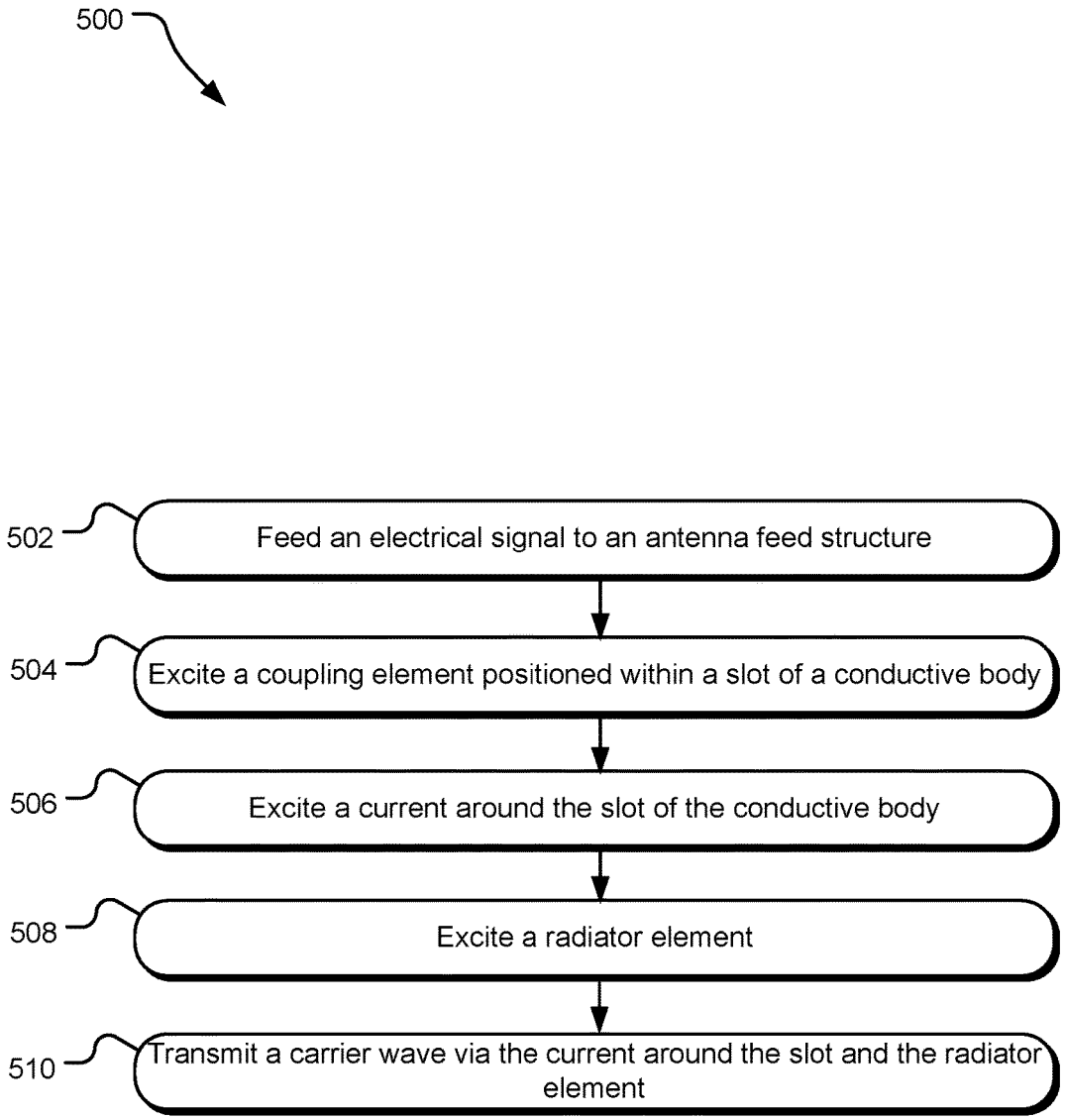
FIG. 5 illustrates example operations for radiofrequency (RF) communication using an antenna assembly having a slot antenna with a conductive radiator element.

A positioning operation 410 positions the antenna assembly in the computing device such that the conductive coupling element is positioned within a slot of a conductive plate, and the conductive radiator element is positioned away from the conductive plate, such that the conductive plate does not shield the operation of the conductive radiator element. A connecting operation 412 connects the antenna feed structure to an antenna feed of the computing device. The antenna feed may be connected to the radio or other communications circuitry of the computing device. Although a variety of components may be suitable for implementing the antenna feed structure, the antenna feed structure is in different implementations, may be in different implementations, a directly soldered connection, a continuous feed, a metal spring contact, a coaxial cable, etc. The antenna feed structure may be electrically grounded FIG. 5 illustrates example operations 500 for radiofrequency (RF) communication using an antenna assembly having a slot antenna with a conductive radiator element. A feeding operation 502 feeds an electrical signal to an antenna feed structure of the antenna assembly. The antenna feed structure may be connected to the antenna feed via a directly soldered connection, a continuous feed, a metal spring contact, a coaxial cable, etc. Furthermore, the antenna feed structure may be connected to a radio or other communications circuitry of a computing device. The antenna feed structure may be electrically grounded. In response to the feeding operation 502, a first exciting operation 504 excites a conductive coupling element positioned with a slot of a conductive plate. The conductive coupling element is excited by the electrical signal fed by the antenna feed structure. The conductive plate may be a portion of a metal case of a computing device such as a laptop computer or a mobile phone. The conductive plate may be printed on an RF transparent material or an RF transparent material may be formed in the slot. As the conductive plate is excited by the exciting operation 504, the conductive plate resonates in a near field resonate frequency. In response to the conductive coupling element resonating in the near field, a second exciting operation 506 excites an edge current of the slot of the conductive plate causing a transmission of a carrier wave (e.g., in the far field). A third exciting operation 508 excites a conductive radiator element. The conductive radiator element is excited by the electrical signal received from the antenna feed structure. The conductive radiator element and the conductive coupling element may be connected to a common feed junction which is connected to the antenna feed structure. The conductive radiator element and the conductive coupling element in combination with the slot may act as cooperatively resonating components, each component (e.g., the conductive radiator element and the conductive coupling element with the slot) providing a contribution to the resonance strength at substantially similar (e.g., overlapping) select RF communication frequencies of the antenna assembly. In some implementations, the conductive radiator element and the conductive coupling element are exited such that the conductive radiator element and the edge current of the slot resonate at different RF communication frequencies. In these implementations, the separate components can be used to communicate using the separate RF communication bands (e.g., dual bands). A transmit operation 510 transmit a carrier wave via the edge current of the slot and the conductive radiator element. The carrier wave may be received by an antenna or other communication device.

An example antenna assembly includes a conductive plate having a slot formed within the conductive plate. A conductive coupling element is positioned within the slot of the conductive plate to form a slot antenna structure with the conductive plate. At least one radiator element is positioned outside of the slot. An antenna feed structure is electrically coupled to the conductive coupling element and the at least one conductive radiator element. The antenna feed structure is configured to simultaneous resonate the slot antenna structure and the at least one conductive radiator element.

Another example antenna assembly of any preceding antenna assembly includes the slot antenna structure and the least one conductive radiator element that resonate at overlapping radiofrequency communication bands when the at least one conductive radiator element and the conductive coupling element are simultaneously driven by a radiofrequency signal provided by the antenna feed structure.

Another example antenna assembly of any preceding antenna assembly includes the antenna fee structure being electrically coupled to the conductive coupling element and the at least one radiator element via a common feed junction.

Another example antenna assembly of any preceding antenna assembly includes the slot antenna structure that resonates in a first radiofrequency communication band when the conductive coupling element is driven by a radiofrequency signal provided by the antenna feed structure. The at least one conductive radiator element is configured to resonate in a second radiofrequency communication band when the conductive radiator element is driven by a radiofrequency signal provide by the antenna feed structure. The second radiofrequency communication band is different from the first radiofrequency communication band.

Another example antenna assembly of any preceding antenna assembly includes the conductive plate being a portion of a metal computing device case.

Another example antenna assembly of any preceding antenna assembly includes the conductive coupling element is positioned on a first plane and the at least one conductive radiator element is positioned on a second plane. The first plane is substantially perpendicular to the second plane.

Another example antenna assembly of any preceding antenna assembly includes the conductive coupling element and the at least one conductive radiator element being positioned in the same face of a computing device case.

Another example antenna assembly of any preceding antenna assembly includes the conductive coupling element being configured to radiate in a near filed to excite an edge current of the slot.

Another example antenna assembly of any preceding antenna assembly includes the conductive coupling element and the at least one conductive radiator element forming a continuous conductive structure.

Another example antenna assembly of any preceding antenna assembly includes the at least one conductive radiator element being tunable to resonate in more than one radiofrequency communication band.

An example method includes coupling a conductive coupling element to an antenna feed structure, the conductive coupling element being positioned to capacitively couple with a slot of a conductive plate to form a slot antenna structure. The method further includes coupling at least one conductive radiator element to the antenna feed structure, the at least one conductive radiator element is positioned outside the slot of the conducive plate. The antenna feed structure is configured to simultaneously resonate the slot antenna structure and the at least one conductive radiator element.

Another example method of any preceding method further includes the slot antenna structure and the at least one conductive radiator element resonating at overlapping radiofrequency communication bands when the at least one conductive radiator element and the conductive coupling element are simultaneously driven by a radiofrequency signal provided by the antenna feed structure.

Another example method of any preceding method further includes the antenna feed structure being electrically coupled to the conductive coupling element and the least one conductive radiator element via a common feed junction.

Another example method of any preceding method further includes the slot antenna structure resonating in a first radiofrequency communication band and the at least one conductive radiator element resonating in a second radiofrequency communication band. The second radiofrequency communication band is different form the first radiofrequency communication band.

Another example method of any preceding method further includes the conductive plate being a portion of a metal computing device case Another example method of any preceding method further includes the conductive coupling element being positioned in a first plane and the at least one conductive radiator element is positioned in a second plane. The first plane is substantially perpendicular to the second plane.

Another example method of any preceding method further includes the conductive coupling element and the at least one conductive radiator element being positioned in the same face of a computing device case.

Another example method of any preceding method further includes the conductive coupling element and the at least one conductive radiator element forming a continuous conductive structure.

Another example method of any preceding method further includes the least one conductive radiator element being tunable to resonate in more than one radiofrequency communication band.

An example method including exiting an edge current of a slot in a conductive plate using a conductive coupling element positioned with the slot, the conductive coupling element is fed by an antenna fees structure. The method further includes exciting at least one conductive radiator element fed by the antenna feed structure, the edge current of the slot and the conductive radiator element resonating at overlapping radiofrequency communication bands.

An example system includes means for coupling a conductive coupling element to an antenna feed structure, the conductive coupling element being positioned to capacitively couple with a slot of a conductive plate to form a slot antenna structure. The system further includes means for coupling at least one conductive radiator element to the antenna feed structure, the conductive coupling element is positioned outside the slot of the conducive plate. The system further includes means for configuring the antenna feed structure to simultaneously resonate the slot antenna structure and the at least one conductive radiator element.

Another example system of any preceding system further includes means for resonating the slot antenna structure and the at least one conductive radiator element at overlapping radiofrequency communication bands when the at least one conductive radiator element and the conductive coupling element are simultaneously driven by a radiofrequency signal provided by the antenna feed structure.

Another example system of any preceding system further includes means for electrically coupling the antenna feed structure to the conductive coupling element and the least one conductive radiator element via a common feed junction.

Another example system of any preceding system further includes means for resonating the slot antenna structure resonating in a first radiofrequency communication band and the at least one conductive radiator element in a second radiofrequency communication band. The second radiofrequency communication band is different form the first radiofrequency communication band.

Another example system of any preceding system further includes means for capacitively coupling the conductive coupling element and the slot of the conductive plate when the conductive coupling element is driven by a radiofrequency single provided by the antenna feed structure.

Another example system of any preceding system further includes means for positioning the conductive coupling element in a first plane and the at least one conductive radiator element in a second plane. The first plane is substantially perpendicular to the second plane.

Another example system of any preceding system further includes means for positioning the conductive coupling element and the at least one conductive radiator element in the same face of a computing device case.

Another example system of any preceding system further includes means for forming the conductive coupling element and the at least one conductive radiator element in continuous conductive structure.

Another example system of any preceding system further includes support for the least one conductive radiator element being tunable to resonate in more than one radiofrequency communication band.

An example system includes means for exciting an edge current of a slot in a conductive plate using a conductive coupling element positioned with the slot. The conductive coupling element is fed by an antenna feed structure. The system further includes means for exciting at least on conductive radiator element fed by the antenna feed structure. The edge current of the slot and the conductive radiator element resonate at overlapping radiofrequency communication bands.

The above specification, examples, and data provide a complete description of the structure and use of exemplary embodiments of the invention. Since many implementations of the invention can be made without departing from the spirit and scope of the invention, the invention resides in the claims hereinafter appended. Furthermore, structural features of the different embodiments may be combined in yet another implementation without departing from the recited claims.

What is claimed is:

1. An antenna assembly comprising:

a conductive plate having a slot formed within the conductive plate;

a conductive coupling element positioned to capacitively couple with the slot of the conductive plate to form a slot antenna structure with the conductive plate, a portion of the conductive coupling element being positioned within the slot and including a long axis, the long axis of the portion of the conductive coupling element being positioned substantially parallel to a long axis of the slot formed within the conductive plate and substantially coplanar with the conductive plate;

at least one conductive radiator element positioned outside of the slot, the at least one conductive radiator element and the conductive coupling element forming a continuous conductive structure; and an antenna feed structure electrically coupled to the conductive coupling element and the at least one conductive radiator element, the antenna feed structure being configured to simultaneously resonate the slot antenna structure and the at least one conductive radiator element, the conductive coupling element and the at least one conductive radiator element forming cooperative resonating components, each of the cooperative resonating components providing a contribution to strength of a radiofrequency (RF) signal at a select RF communication band.

2. The antenna assembly of claim 1, wherein the slot antenna structure and the at least one conductive radiator element resonate at overlapping RF communication bands defining the select RF communication band when the at least one conductive radiator element and the conductive coupling element are simultaneously driven by a radiofrequency signal provided by the antenna feed structure, wherein overlapping radiofrequency communication bands are defined by a band pass cutoff condition.

3. The antenna assembly of claim 1, wherein the antenna feed structure is electrically coupled to the conductive coupling element and the at least one conductive radiator element via a common feed junction.

4. The antenna assembly of claim 3 wherein the at least one conductive radiator element extends from the common feed junction and includes a non-grounded free end.

5. The antenna assembly of claim 1, wherein the conductive plate is a portion of a metal computing device case.

6. The antenna assembly of claim 1, wherein the conductive coupling element is positioned on a first plane and the at least one conductive radiator element is positioned on a second plane, the first plane being substantially perpendicular to the second plane.

7. The antenna assembly of claim 1, wherein the conductive coupling element and the at least one conductive radiator element are positioned in a same face of a computing device case.

8. The antenna assembly of claim 1, wherein the conductive coupling element is configured to radiate in a near field to excite an edge current of the slot.

9. The antenna assembly of claim 1, wherein the at least one conductive radiator element is tunable to resonate in more than one radiofrequency communication band.

10. The antenna assembly of claim 1 wherein a long axis of the at least one conductive radiator element is positioned substantially parallel to the long axis of the portion of the conductive coupling element and the long axis of the slot formed within the conductive plate.

11. A method comprising:

coupling a conductive coupling element to an antenna feed structure, the conductive coupling element being positioned to capacitively couple with a slot formed within a conductive plate to form a slot antenna structure with the conductive plate, a portion of the conductive coupling element being positioned within the slot and including a long axis, the long axis of the portion of the coupling element being positioned substantially parallel to a long axis of the slot formed within the conductive plate and substantially coplanar with the conductive plate; and coupling at least one conductive radiator element to the antenna feed structure, the at least one conductive radiator element being positioned outside the slot of the conductive plate, the conductive coupling element and the at least one conductive radiator element forming a continuous conductive structure, the antenna feed structure being configured to simultaneously resonate the slot antenna structure and the at least one conductive radiator element, the conductive coupling element and the at least one conductive radiator element forming cooperative resonating components, each of the cooperative resonating components providing a contribution to strength of a radiofrequency (RF) signal at a select RF communication band.

12. The method of claim 11, wherein the slot antenna structure and the at least one conductive radiator element resonate at overlapping RF communication bands defining the select RF communication when the at least one conductive radiator element and the conductive coupling element are simultaneously driven by a radiofrequency signal provided by the antenna feed structure, wherein overlapping radiofrequency communication bands are defined by a band pass cutoff condition.

13. The method of claim 11, wherein the antenna feed structure is electrically coupled to the conductive coupling element and the at least one conductive radiator element via a common feed junction.

14. The method of claim 11, wherein the conductive plate is a portion of a metal computing device case.

15. The method of claim 11, wherein the conductive coupling element is positioned in a first plane and the at least one conductive radiator element is positioned in a second plane, the first plane being substantially perpendicular to the second plane.

16. The method of claim 11, wherein the conductive coupling element is positioned and the at least one conductive radiator element are positioned in a same face of a computing device case.

17. The method of claim 11, wherein the conductive coupling element and the at least one conductive radiator element form a continuous conductive structure.

18. The method of claim 11, wherein the at least one conductive radiator element is tunable to resonate in more than one radiofrequency communication band.

19. A method comprising:

exciting an edge current of a slot in a conductive plate using a conductive coupling element positioned to capacitively couple with the slot formed within the conductive plate, the conductive coupling element being fed by an antenna feed structure, a portion of the conductive coupling element being positioned within the slot and including a long axis, the long axis of the portion of the coupling element being positioned substantially parallel to a long axis of the slot formed within the conductive plate and substantially coplanar with the conductive plate; and exciting at least one conductive radiator element fed by the antenna feed structure and positioned outside of the slot, the at least one conductive radiator element and the conductive coupling element forming a continuous conductive structure, an edge current of the slot and the conductive radiator element resonating at overlapping radiofrequency communication bands, wherein overlapping radiofrequency communication bands are defined by a band pass cutoff condition, the antenna feed structure being configured to simultaneously resonate the slot antenna structure and the at least one conductive radiator element, the conductive coupling element and the at least one conductive radiator element forming cooperative resonating components, each of the cooperative resonating components providing a contribution to strength of a radiofrequency (RF) signal at a select RF communication band.

* * * * *